US010100457B2

(12) United States Patent
Jo et al.

(10) Patent No.: US 10,100,457 B2
(45) Date of Patent: Oct. 16, 2018

(54) WASHING MACHINE

(71) Applicant: LG ELECTRONICS INC., Seoul (KR)

(72) Inventors: Mingyu Jo, Seoul (KR); Seungchul Park, Seoul (KR); Dongwon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 79 days.

(21) Appl. No.: 15/147,147

(22) Filed: May 5, 2016

(65) Prior Publication Data

US 2016/0326687 A1 Nov. 10, 2016

(30) Foreign Application Priority Data

May 8, 2015 (KR) ..... 10-2015-0064507
May 8, 2015 (KR) ..... 10-2015-0064509

(51) Int. Cl.

| | |
|---|---|
| ***D06F 37/04*** | (2006.01) |
| ***D06F 37/22*** | (2006.01) |
| ***D06F 37/26*** | (2006.01) |
| ***D06F 37/28*** | (2006.01) |
| ***D06F 39/14*** | (2006.01) |

(52) U.S. Cl.
CPC ..... *D06F 39/14* (2013.01); *D06F 37/265* (2013.01); *D06F 37/28* (2013.01); *D06F 37/04* (2013.01); *D06F 37/22* (2013.01)

(58) Field of Classification Search
CPC ..... D06F 37/22; D06F 37/28; D06F 39/14; D06F 37/265
See application file for complete search history.

(56) References Cited

U.S. PATENT DOCUMENTS 2,412,270 A * 12/1946 Johnston ..... D06F 39/14 177/144
5,881,579 A * 3/1999 Ellingson ..... D06F 23/06 68/139
6,539,753 B1 * 4/2003 Ito ..... D06F 23/06 68/140
2005/0103062 A1 * 5/2005 Wirthwein ..... D06F 37/262 68/19
2006/0000244 A1 * 1/2006 Kim ..... D06F 37/20 68/23.1

(Continued)

FOREIGN PATENT DOCUMENTS

EP 2141277 3/2014
GB 2360297 A * 9/2001 ..... D06F 39/14

(Continued)

*Primary Examiner* — Joseph L. Perrin
(74) *Attorney, Agent, or Firm* — Fish & Richardson P.C.

(57) ABSTRACT

A washing machine includes a cabinet that defines a first introduction port. The washing machine further includes a tub that is located in the cabinet and that defines a second introduction port that is concentrically positioned relative to the first introduction port. The washing machine further includes a cabinet door that is connected to the cabinet and that is configured to open and close the first introduction port. The washing machine further includes a tub door that is hingedly coupled to the tub, that is configured to open and close the second introduction port, and that includes an upper portion that is inclined toward the tub.

21 Claims, 20 Drawing Sheets

(56) References Cited

U.S. PATENT DOCUMENTS

| | | | | |
|---|---|---|---|---|
| 2011/0120195 | A1* | 5/2011 | Jeoung | D06F 37/28 68/139 |
| 2015/0089832 | A1* | 4/2015 | Kang | D06F 25/00 34/499 |
| 2016/0273149 | A1* | 9/2016 | Jo | D06F 37/28 |

FOREIGN PATENT DOCUMENTS

| | | | | |
|---|---|---|---|---|
| JP | 2006280401 | A * | 10/2006 | D06F 39/14 |
| KR | 10-0751779 | | 8/2007 | |
| KR | 10-2011-0057920 | | 6/2011 | |
| KR | 10-2011-0120134 | | 11/2011 | |
| KR | 10-2012-0043263 | | 5/2012 | |

* cited by examiner

WASHING MACHINE

CROSS REFERENCE TO RELATED APPLICATIONS

This application claims the benefit of Korean Patent Applications Nos. 10-2015-0064509 and 10-2015-0064507, both filed on May 8, 2015, which are hereby incorporated by reference as if fully set forth herein.

FIELD

This application relates to a washing machine.

BACKGROUND

Generally, a washing machine refers to an electrical household product constructed to remove various contaminants from clothes, bedclothes and the like by employing the emulsification of detergent, rubbing action and impact action, which are applied to laundry by water streams generated by the rotation of a pulsator or a drum, and the like. Fully-automatic washing machines, which have recently been proposed, are constructed to automatically perform a series of courses composed of a washing course, a rinsing course, a dewatering course and the like, without the need for intervening manipulation on the part of the user.

SUMMARY

According to an innovative aspect of the subject matter described in this application, a washing machine includes a cabinet that defines a first introduction port; a tub that is located in the cabinet and that defines a second introduction port that is concentrically positioned relative to the first introduction port; a cabinet door that is connected to the cabinet and that is configured to open and close the first introduction port; and a tub door that is hingedly coupled to the tub, that is configured to open and close the second introduction port, and that includes an upper portion that is inclined toward the tub.

The washing machine may include one or more of the following optional features. The washing machine includes a rim that is located around the second introduction port and that extends from the tub in a forward direction. The tub is obliquely positioned and includes a front portion that is inclined upward, and the cabinet includes a front cabinet that includes an upper portion that is inclined rearward at a predetermined angle. The tub is inclined upward at an angle of 5-15 degrees relative to a bottom of the washing machine. The tub is inclined upward at an angle of 10 degrees relative to the bottom of the washing machine. The tub includes a rim that extends from the second introduction port to the first introduction port. An upper portion of the rim extends beyond a lower portion of the rim. The cabinet door is obliquely positioned and includes an upper portion that is inclined rearward at an angle of 1.5-3.5 degrees relative to a front of the washing machine. The cabinet door is inclined rearward at an angle of 2.5 degrees relative to the front of the washing machine. The tub door is obliquely positioned and includes an upper portion that is inclined rearward at an angle of 1.5-3.5 degrees relative to a front of the washing machine.

The tub door is inclined rearward at an angle of 2.5 degrees relative to the front of the washing machine. The cabinet door includes a front hinge unit, and the tub door includes a second hinge unit that includes a rotating shaft that is spaced apart from the first hinge unit. The washing machine includes a cover member that is connected to the tub and that is configured to cover a portion of a front surface of the tub between the first introduction port and the second introduction port. The cover member includes a first cover submember that is configured to cover the first introduction port and a second cover submember that is configured to cover the second introduction port. The washing machine includes a rim that is located around the second introduction port and that extends from the tub in a forward direction. The cover member is connected to the rim and is configured to cover the front surface of the tub outside the rim. The washing machine includes a weight balancer that is located on an outer circumferential surface of the rim and that is configured to increase a weight of the tub. The cover member is coupled to the weight balancer and is configured to cover the weight balancer.

The rim is located at an outer side of the washing machine and includes a water supply unit that is configured to supply washing water to the tub and an air supply unit that is configured to supply dry air to the tub, and the cover member is configured to cover the water supply unit and the air supply unit. The tub door is elastically supported in a direction that the second introduction port opens. The cabinet door is configured to open based on opening the tub door. The tub door is configured to close based on closing the cabinet door. The cabinet includes a cabinet door lock that is configured to lock the cabinet door, and the tub includes a tub door lock that is configured to lock the tub door. The washing machine includes a lock-releasing device that is configured to unlock the tub door based on the cabinet door opening. The lock-releasing device includes a release lever that is located at a handle of the cabinet door; a release switch that is configured to detect an action of opening of the cabinet door in response to detecting an action of the release lever; and a tub door lock releaser that is configured to unlock the tub door lock in response to detecting an action of the release switch. The lock-releasing device includes a release lever that is located at a handle of the cabinet door; a release switch that is configured to detect an action of opening of the cabinet door in response to detecting an action of the release lever; and a tub door lock that is configured to unlock the tub door in response to detecting an action of opening by the release switch.

An object of the subject matter described in this application is to provide a washing machine, in which the structure between a tub and a cabinet is improved so as to prevent vibrations or noise, generated in the tub, from being transmitted to the cabinet through a gasket.

Another object of the subject matter described in this application is to provide a washing machine, in which the internal structure between a tub and a cabinet is improved so as to greatly increase the capacity of the tub, compared to a conventional washing machine.

DETAILED DESCRIPTION

Figure 1:
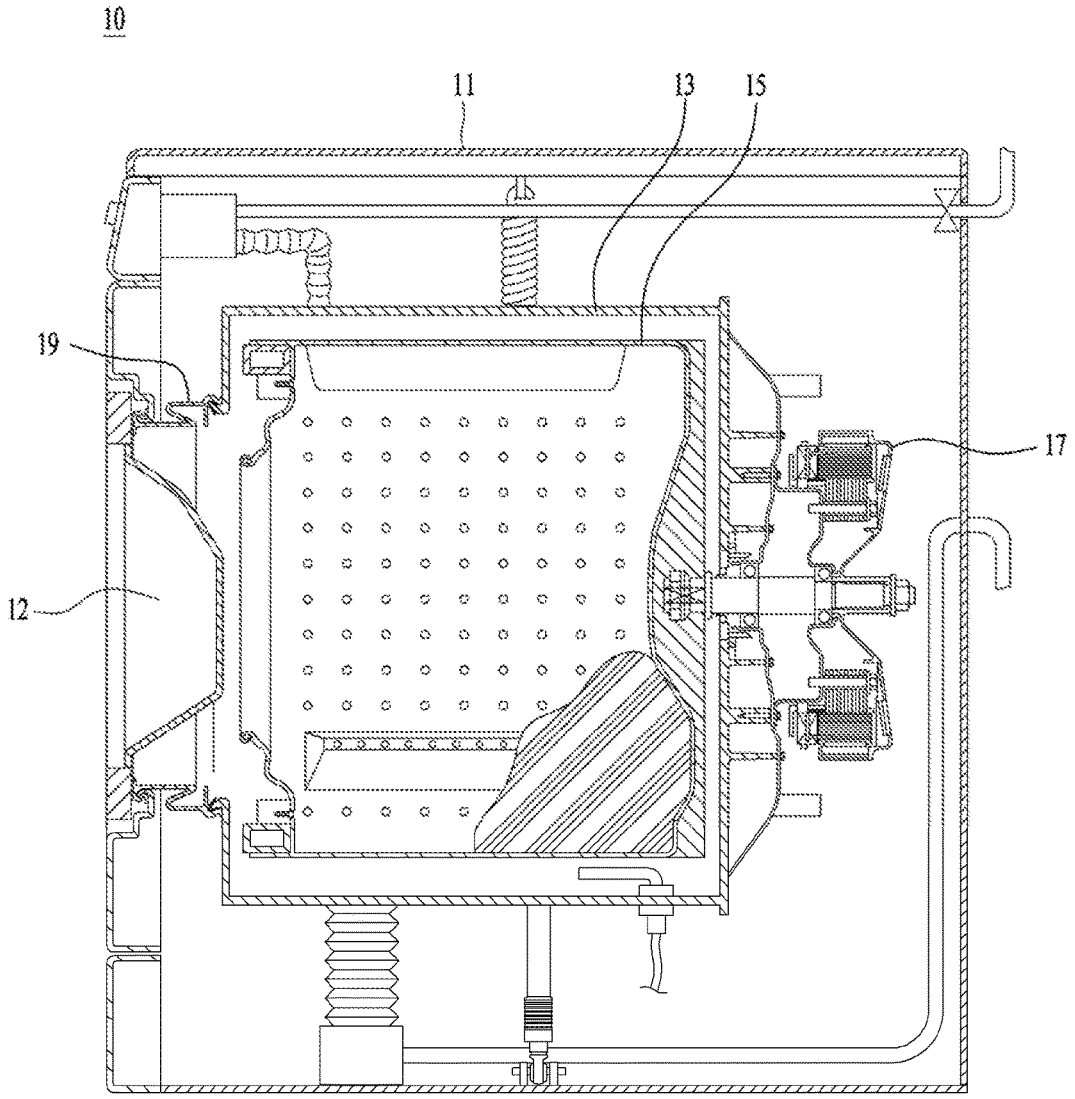
FIG. 1 is a schematic view of an example washing machine.

FIG. 1 illustrates an example washing machine 10. As shown in FIG. 1, the washing machine 10 includes a cabinet 11, defining the appearance of the washing machine 10, a tub 13, which is supported inside the cabinet 11 by means of a damper and a spring and which contains washing water, and a cylindrical drum 15, which is disposed inside the tub 13 to contain laundry and which receives driving force from the drive unit 17 for washing the laundry contained in the drum 15. This washing machine 10 may include a gasket 19 between the opening of the tub 13 and the cabinet 11 so as to prevent washing water contained in the tub 13 from leaking.

When the drum 15 rotates to wash and dehydrate the laundry contained therein, this conventional washing machine 10, which is constructed as described above, may vibrate because of the rotation of the drum 15, eccentric disposition of laundry or the like, and the vibrations generated by the rotation of the drum 15 are transmitted to the outside through the tub 13 and the cabinet 11. The vibrations and noise transmitted to the tub 13 are transmitted to the cabinet 11 through the gasket 19, which functions to maintain the watertight state between the cabinet 11 and the tub 13, thereby subjecting the cabinet 11 to vibrations and noise.

In the washing machine 10, the laundry may become caught between the door 12 for closing the tub 13 and the drum 15. In order to prevent laundry from being caught between the door and the drum, the door 12 is constructed such that the inner surface of the door 12 projects toward the inside of the opening in the tub 13 or the drum 15. In some implementations, the projecting structure of the door 12 occupies part of the washing volume in the drum 15, thereby possibly reducing the washing capacity of the washing machine 10.

Figure 2:
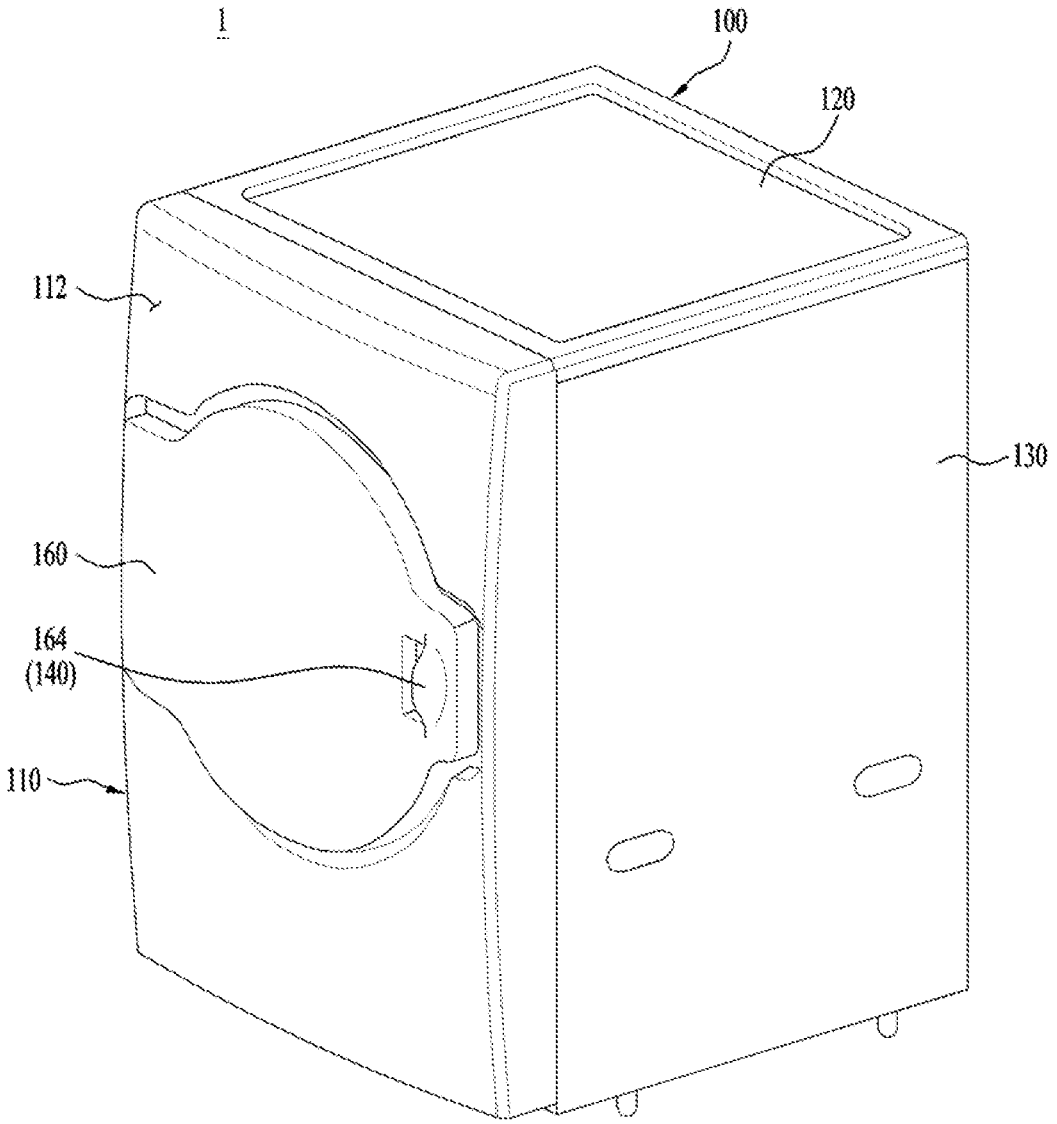
FIG. 2 is a perspective view of an example washing machine.
Figure 3:
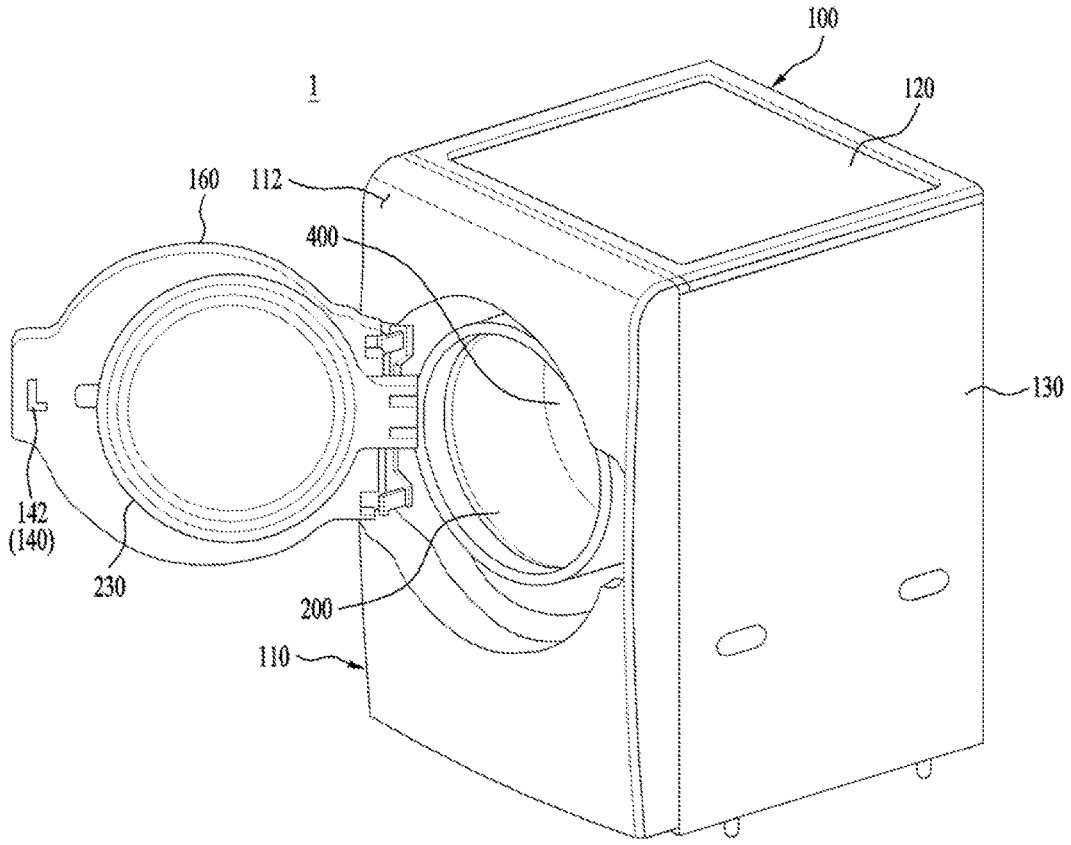
FIG. 3 is a perspective view of an example washing machine with an open door.

FIGS. 2 and 3 illustrate example washing machines.

As illustrated in FIGS. 2 and 3, the washing machine 1 includes a cabinet 100 defining the appearance of the washing machine, a tub 200, which is supported by a suspension such as a damper and/or a spring in the cabinet 100 so as to contain washing water, a drum 400 rotatably disposed in the tub 200 so as to contain laundry, and a drive unit for rotating the drum 400.

The cabinet 100 may include a front cabinet 110 defining the front part of the washing machine, right and left cabinets 130 defining the right and left parts of the washing machine, and an upper cabinet 120 defining the upper part of the washing machine.

Here, the front cabinet 110 is provided at the center thereof with a first introduction port 114, through which laundry is introduced into the loading space in the drum 400, and the first introduction port 114 is provided with a cabinet door 160 for opening and closing the first introduction port 114.

The front cabinet 110 may be provided above the first introduction port 114 with a control panel 112, which includes manipulation and display parts for controlling and displaying the overall operation of the washing machine 1.

The tub 200 is provided at the front face thereof with a second introduction port 210, which is open so as to allow laundry, introduced through the first introduction port 114, to be loaded into the drum 400. The second introduction port 210 is provided with a tub door 230 for opening and closing the second introduction port 210.

Figure 14:
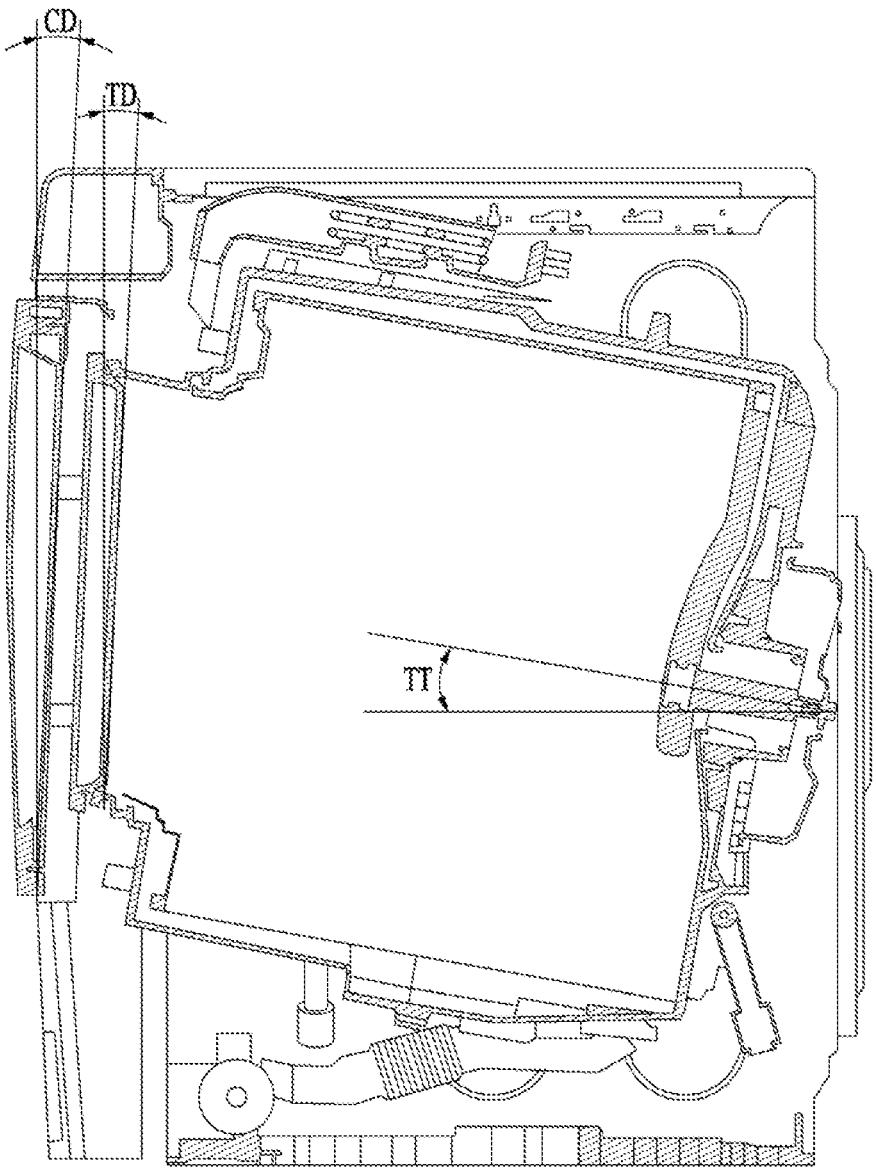
FIG. 14 is a side cross-sectional view of a mounted state of an example cabinet door and an example tub door of a washing machine.

The tub 200 is inclined at a predetermined angle (TT, see FIG. 14) such that the second introduction port 210 is inclined upward so as to allow laundry to move during rotation of the drum and so as to allow laundry to be easily introduced and taken out of the drum by a user.

In addition to the inclined installation of the tub 200, the drum 400 is also disposed in the tub 200 in the state of being inclined at the same angle of inclination as that of the tub 200.

The angle of inclination (TT), at which the tub 200 and the drum 400 are installed, is within a range of 5-15 degrees. In some implementations, the angle of inclination of the tub 200 and the drum 400 is about 10 degrees in consideration of user's convenience and washing performance.

Figure 4:
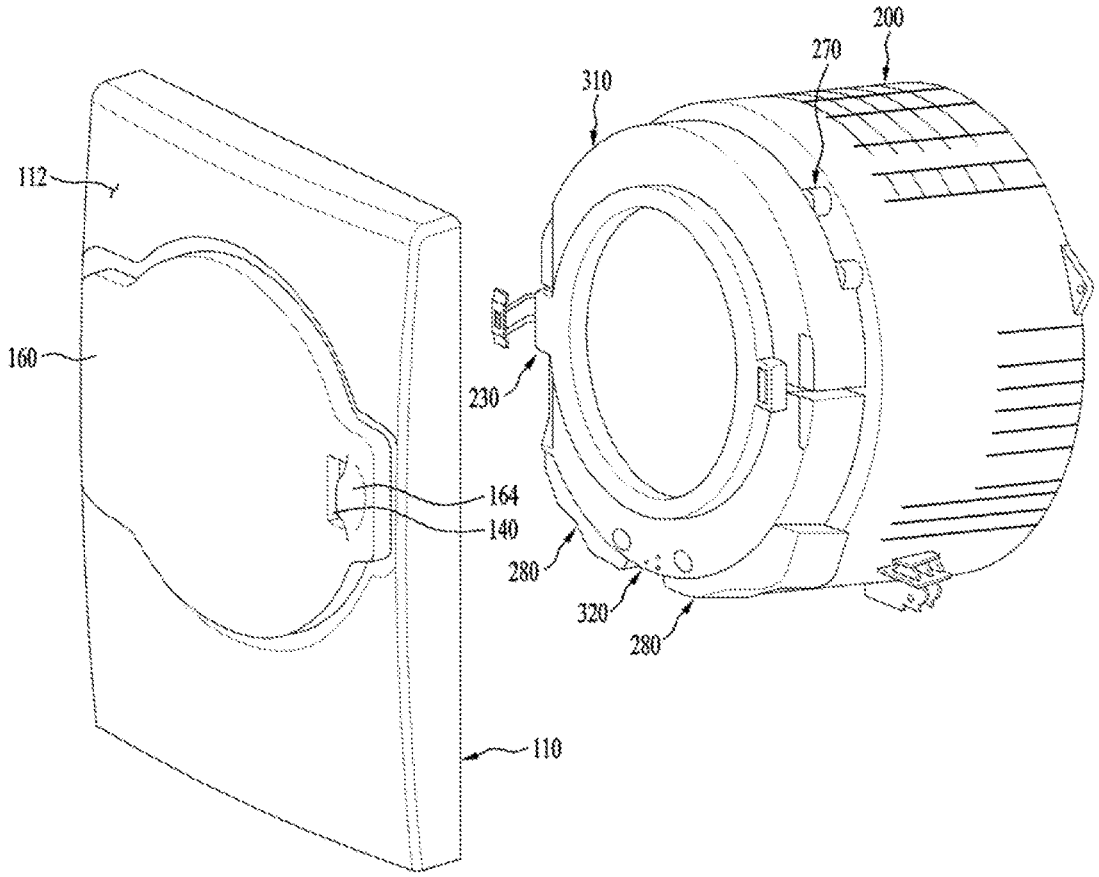
FIG. 4 is a perspective view of an installed state of an example cabinet door and an example tub door.
Figure 5:
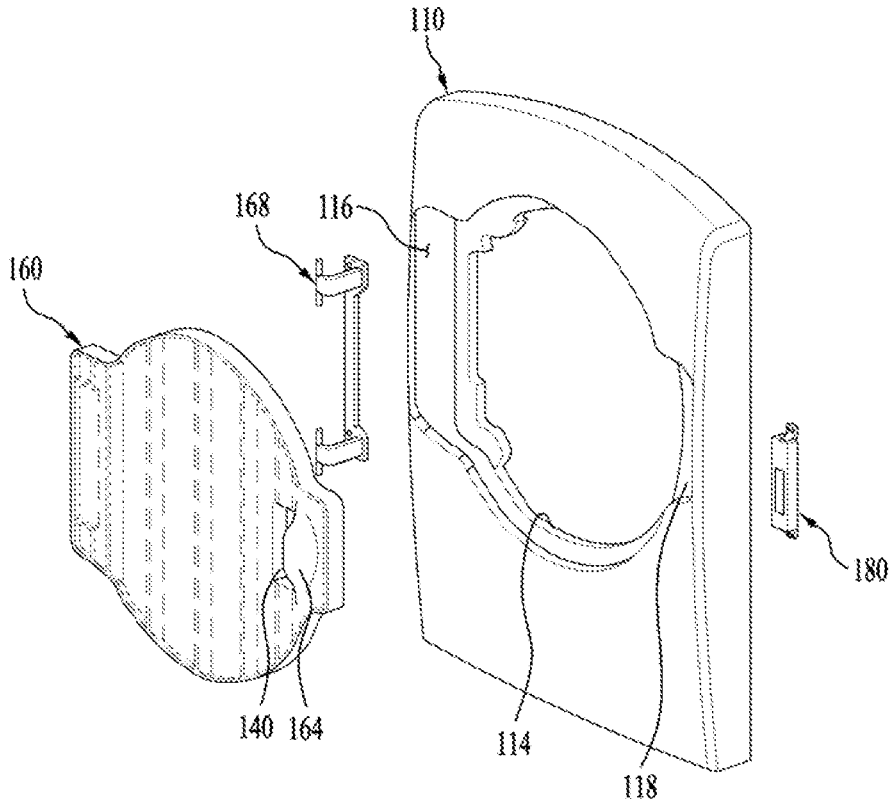
FIG. 5 is an exploded perspective view of an installed state of an example cabinet door and an example tub door.

FIGS. 4 and 5 illustrate example cabinet doors and example tub doors.

As illustrated in FIGS. 4 and 5, the first introduction port 114, which is formed in the front cabinet 110, is provided at a first side thereof with a cabinet hinge mount 116, which is pressed into the front cabinet 110 so as to allow the cabinet door 160 to be rotatably mounted thereon. The first introduction port 114 is provided at a second side opposite the cabinet hinge mount 116 with a cabinet door lock mount 118 so as to allow the locked state of the cabinet door 160 to be set.

A cabinet door lock 180 is mounted in the cabinet door lock mount 118 so as not to protrude outward from the front cabinet 110. The cabinet door 160 is provided at a second side thereof with a handle 164 for opening and closing of the cabinet door 160.

The handle 164 is provided therein with a lock-releasing device 140 for locking and releasing the cabinet door 160 and the tub door 230. The lock-releasing device 140 is configured to concurrently release both the cabinet door 160, which is locked by the cabinet door lock 180, and the tub door 230, which is locked by the tub door lock 260. The lock-releasing device 140 will be described later together with the cabinet door 160.

Figure 6:
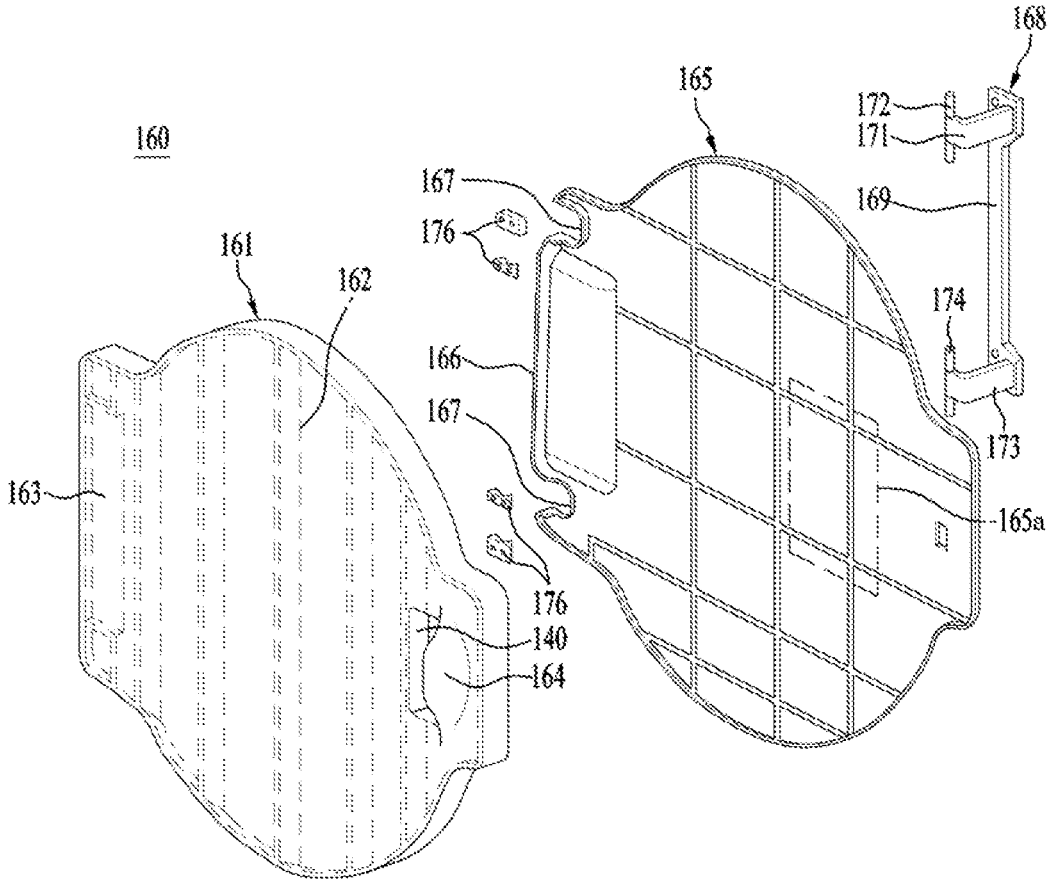
FIG. 6 is an exploded perspective view of an example cabinet door of a washing machine.

As illustrated in FIG. 6, the cabinet door 160, which is rotatably provided at the first introduction port 114 of the front cabinet 110 so as to open and close the first introduction port 114, includes a first outer frame 161 for constituting the outer part of the cabinet door 160, a first inner frame 165 for constituting the inner part of the cabinet door 160, and a first hinge unit 168 for rotatably supporting the cabinet door 160.

The first outer frame 161 and the first inner frame 165 may be coupled to each other by means of fastening elements such as bolts, and may be made from a transparent material so as to allow the operational state inside the washing machine 1 to be checked from the outside.

The outer surface of the cabinet door 160 (e.g. the outer surface of the first outer frame 161) may be configured to serve as an extended surface of the front cabinet 110, which extends along the outer surface of the front cabinet 110. The handle 164 for opening and closing the cabinet door 160 is disposed at the second side, opposite the first hinge unit 168.

The first outer frame 161 may be provided on the inner surface thereof with a plurality of reinforcing ribs 162 for increasing the strength of the first outer frame 161.

The cabinet door 160 is provided on the inner surface thereof (e.g. the outer surface of the first inner frame 165) with a roller-pushing surface 165*a* for pushing a push roller 250 of the tub door 230, which will be described later.

The roller-pushing surface 165*a* serves to push a push roller 250 of the tub door 230 so as to cause the tub door 230 to be closed in conjunction with the cabinet door 160 when the cabinet door 160 is pushed and closed by a user.

The cabinet door 160 is provided at the first side thereof with the first hinge unit 168, which is mounted on the cabinet hinge mount 116 so as to rotatably support the cabinet door 160.

The handle 164, which is formed on the first outer frame 161, is provided therein with the lock-releasing device 140, which engages with the cabinet door lock 180 when the first introduction port 114 is closed by the cabinet door 160, and which releases the locked state of the cabinet door lock 180 in response to a user's manipulation. The lock-releasing device 140 will be described later together with the cabinet door lock 180.

The first outer frame 161 includes a projection 163 at which the first hinge unit 168 is installed, and the first inner frame 165 includes a projection 166, which is disposed at a position corresponding to the projection 163 of the first outer frame 161.

The first inner frame 165 is provided above and below the projection 166 with a pair of recesses 167, in which upper and lower rotators 171 and 173 of the first hinge unit 168, which will be described later, are received. Each of the pair of recesses 167 is provided with a pair of brackets 176 for rotatably supporting an upper or lower rotating shaft 172 or 174 of the first hinge unit 168, which will be described later.

The projection 166, the recesses 167 and the brackets 176, which are provided at the first inner frame 165, are covered by the projection 163 of the first outer frame 161 so as not to be visible from the outside when the first outer frame 161 is combined with the first inner frame 165.

The first hinge unit 168 includes a hinge body 169 coupled to the cabinet hinge mount 116 formed at the first introduction port 114, the upper and lower rotators 171 and 173, which respectively extend from the upper and lower ends of the hinge body 169, and the upper and lower rotating shafts 172 and 174, which extend from respective ends of the upper and lower rotators 171 and 173.

The upper and lower rotators 171 and 173, which are formed on the hinge body 169 of the first hinge unit 168, may be spaced apart from each other by a predetermined interval. In some implementations, the upper and lower rotators 171 and 173 are spaced apart from each other by a predetermined interval so as not to overlap a second hinge unit 242 of the tub door 230, which will be described later, and a second hinge unit 242 of the tub door 230 is disposed between the upper and lower rotators 171 and 173.

The door lock mount 118, which is provided at the second side of the first introduction port 114 of the front cabinet 110, is provided with the cabinet door lock 180, into which a cabinet door hook 142 of the lock-releasing device 140 is fitted and locked.

The cabinet door 160 may be inclined at a predetermined angle (CD, see FIG. 14) so as to facilitate the closing rotation of the cabinet door 160. If the rotating axis of the first hinge unit 168 is vertically positioned, it is difficult for the opened cabinet door 160 to be rotated by gravity.

When the rotating axis of the first hinge unit 168 is inclined in the forward or rearward direction of the front cabinet 110, the cabinet 160 coupled to the first hinge unit 168 may be rotated by its own weight in one direction (e.g. in the direction in which the cabinet door 160 is opened) or in the opposite direction (e.g. in the direction in which the cabinet door 160 is closed) depending on the opened position of the cabinet door 160.

The washing machine will be described based on the state in which the upper end of the rotating axis of the first hinge unit 168 is inclined in the rearward direction of the front cabinet 110 (e.g. in the inward direction of the washing machine 1) at a predetermined angle. The angle of inclination of the rotating axis of the first hinge unit 168 is within a range of about 1.5-3.5 degrees, and typically about 2.5 degrees.

In some implementations, when the cabinet door 160 is opened to an angle less than the predetermined angle, the cabinet door 160 is rotated by its own weight in the direction in which the cabinet door 160 is closed. When the cabinet door 160 is opened to an angle equal to or greater than the predetermined angle, the cabinet door 160 is rotated in the direction in which the cabinet door 160 is opened.

Figure 7:
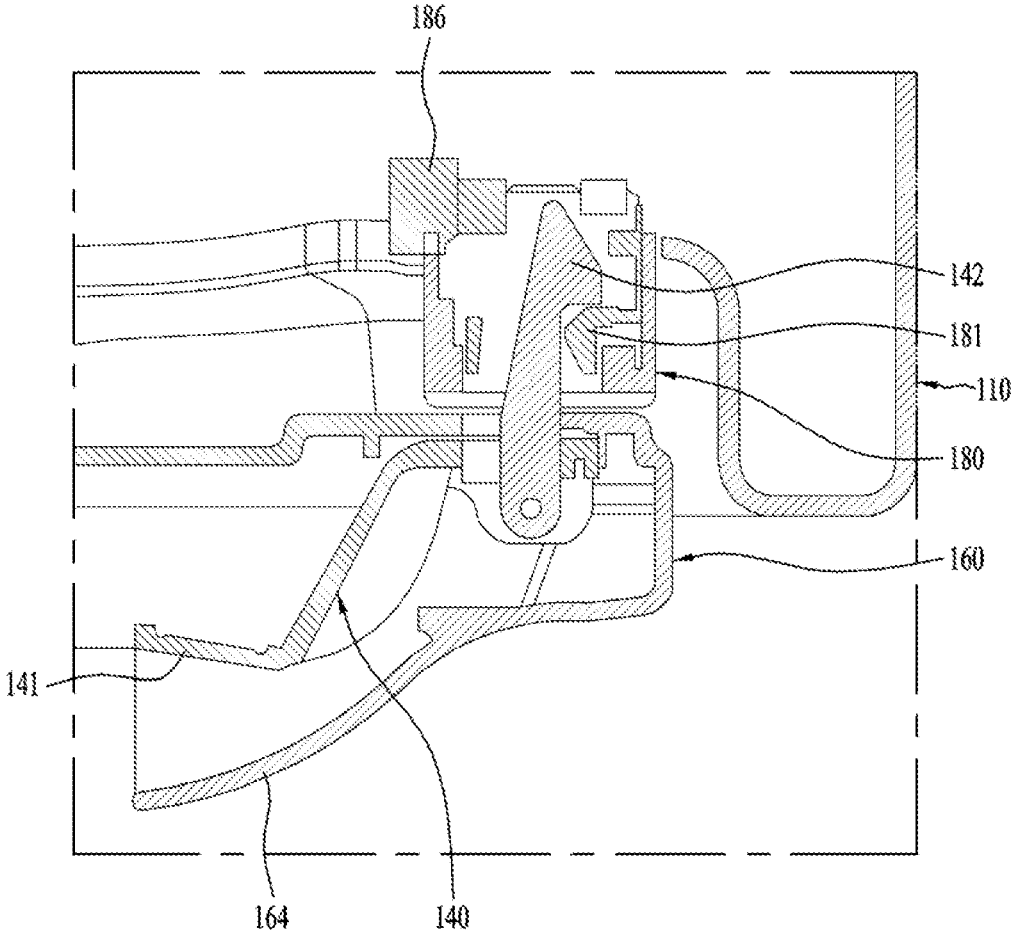
FIG. 7 is a cross-sectional view of an example lock-releasing device of a washing machine.
Figure 8:
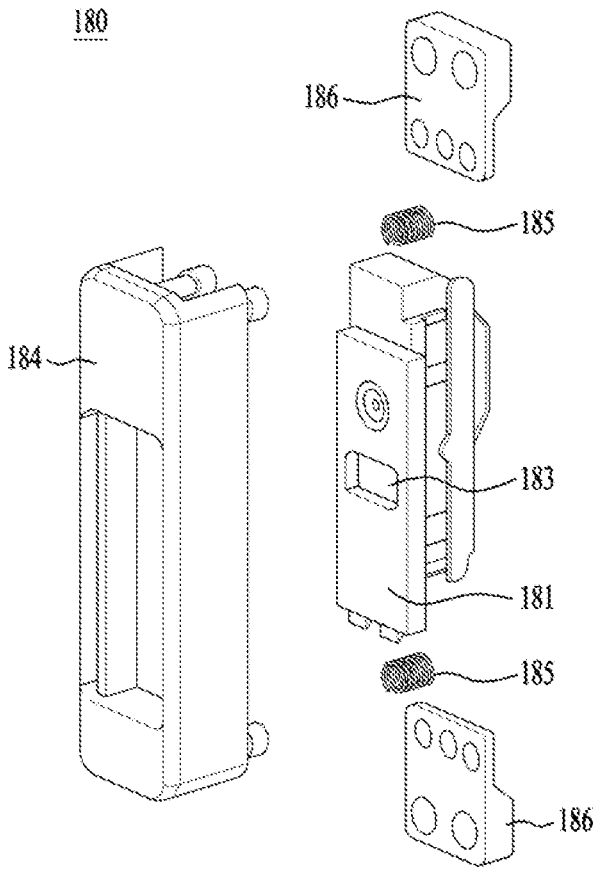
FIG. 8 is an exploded perspective view of an example cabinet door lock of a washing machine.

FIG. 7 illustrates an example lock-releasing device of a washing machine. FIG. 8 illustrates an example cabinet door lock 180 of a washing machine.

As illustrated in FIG. 7, the lock-releasing device 140 is disposed inside the handle 164 so as to release the locked state of the cabinet door lock 180 by a user's pulling force when a user grasps the handle 164 to open the cabinet door 142. The lock-releasing device 140 includes a release lever 141, a cabinet door hook 142, which is locked by the cabinet door lock 180 when the first introduction port 114 of the cabinet door 160 is closed and which is released from the state of being locked to the cabinet door lock 180 when the release lever 141 is pulled, and a torsional spring 143 for elastically biasing the cabinet door hook 142 in the direction in which the cabinet door hook 142 is engaged with the cabinet door lock 180.

The cabinet door lock 180 is intended to control the locked state of the cabinet door 160, which is coupled to the first introduction port 114. The cabinet door lock 180 includes a hook holder 181 secured to the cabinet door lock mount 118 of the front cabinet 110, a hook fitting portion 183, which is disposed outside the cabinet door lock mount 118 and which is coupled to the hook holder 181 so as to be movable in the direction in which the cabinet door hook 142 is fitted, an elastic support 184 for elastically supporting the hook fitting portion 183 in the direction opposite the direction in which the cabinet door hook 142 is fitted, and a lock-releasing switch 186 for detecting the action of the cabinet door hook 142 when the locked state in which the cabinet door hook 142 is engaged with the hook holder 181 is released. The lock-releasing switch 186 generates an electrical signal for activation of a tub door releaser 220 (see FIG. 15), which will be described later.

The cabinet door lock 180 has a moving space such that the hook fitting portion 183 is elastically displaced in the moving space by the elastic support 184 after the cabinet door hook 142 is engaged with the hook holder 181 when the cabinet door 160 is closed. By virtue of the moving space, after the cabinet door 160 is locked by the hook holder 181 of the cabinet door lock 180, the tub door 230 is further pushed so as to be closed. The interlocking structure between the cabinet door 160 and the tub door 230 will be described in detail when the operation of the cabinet door 160 and the tub door 230 is described.

Hereinafter, the tub and the tub door will be described in detail with reference to the accompanying drawings.

Figure 9:
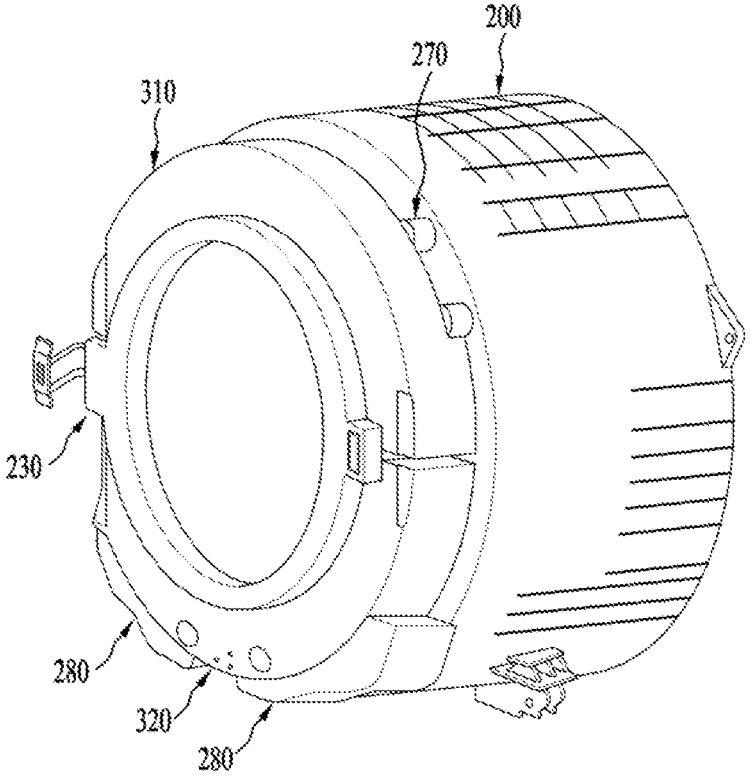
FIG. 9 is a perspective view of an example tub assembly of a washing machine.
Figure 10:
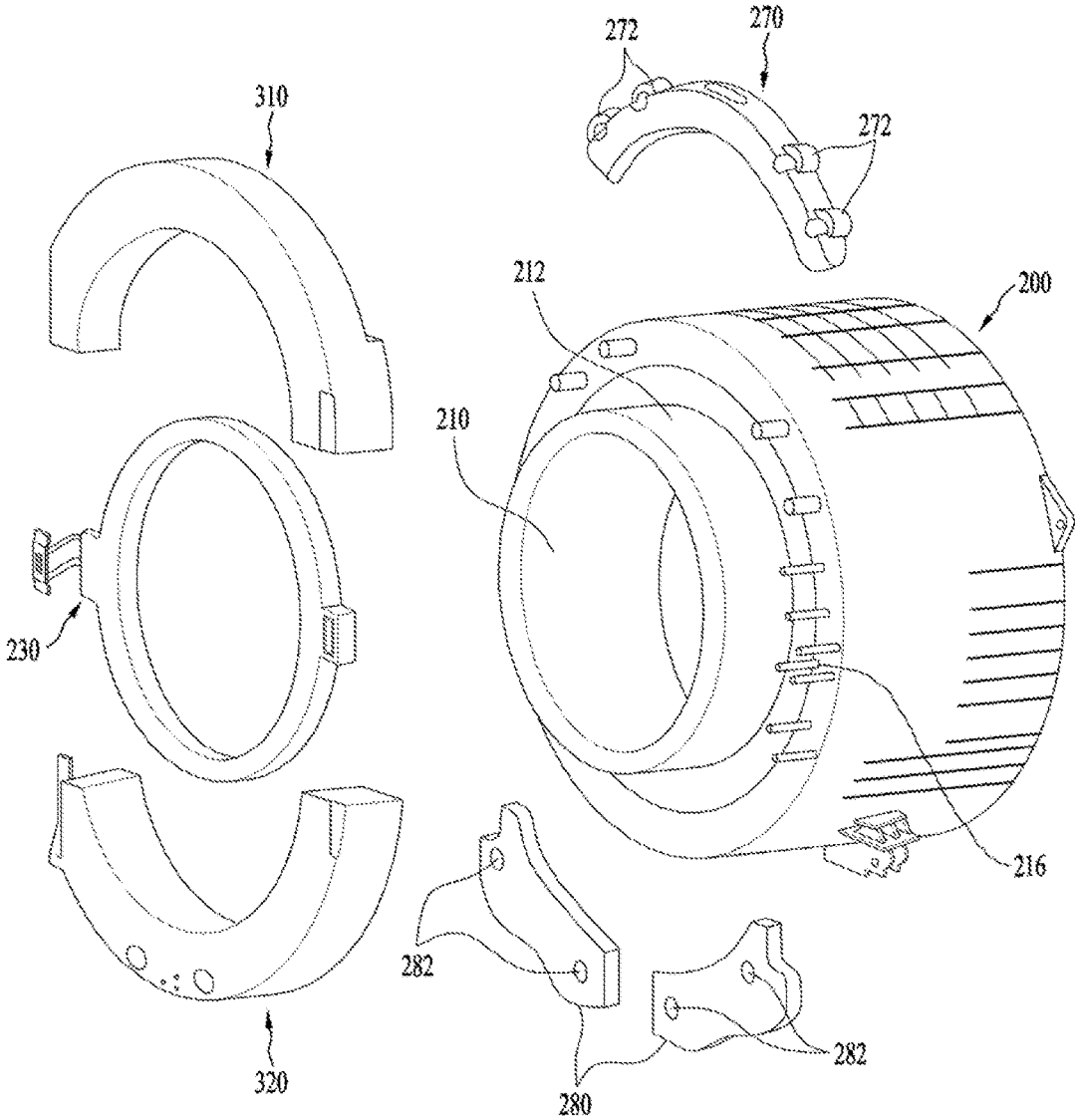
FIG. 10 is an exploded perspective view of an example tub assembly of a washing machine.
Figure 11:
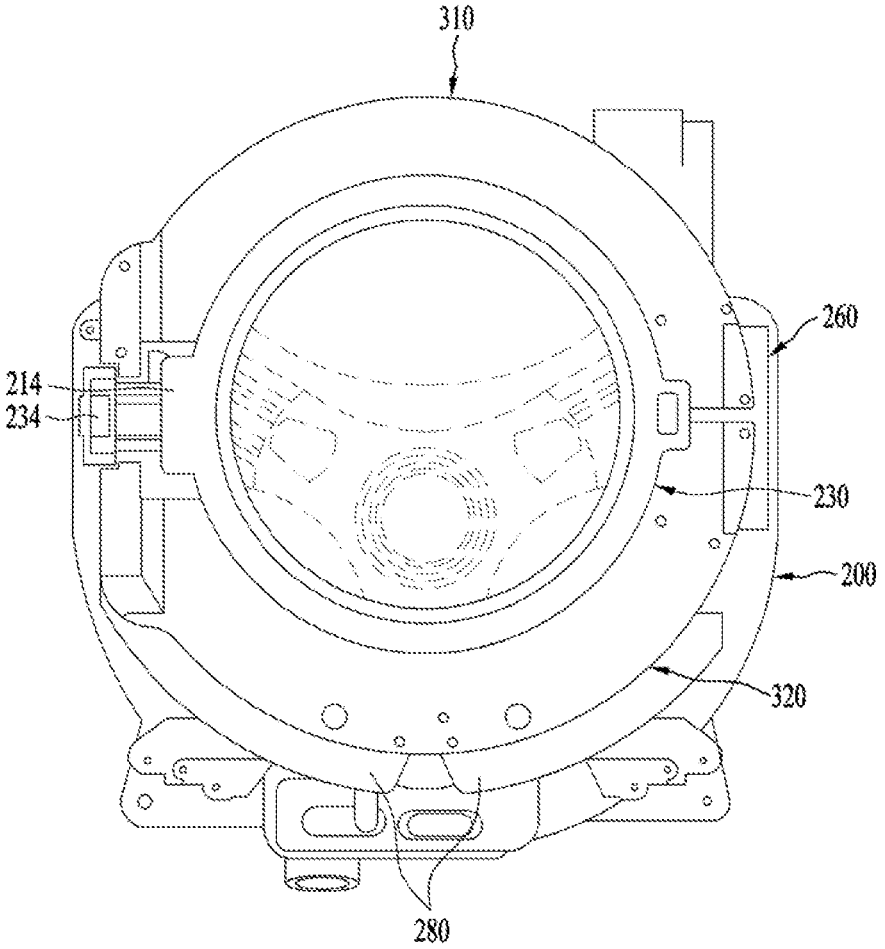
FIG. 11 is a front view of an example tub assembly of a washing machine.
Figure 12:
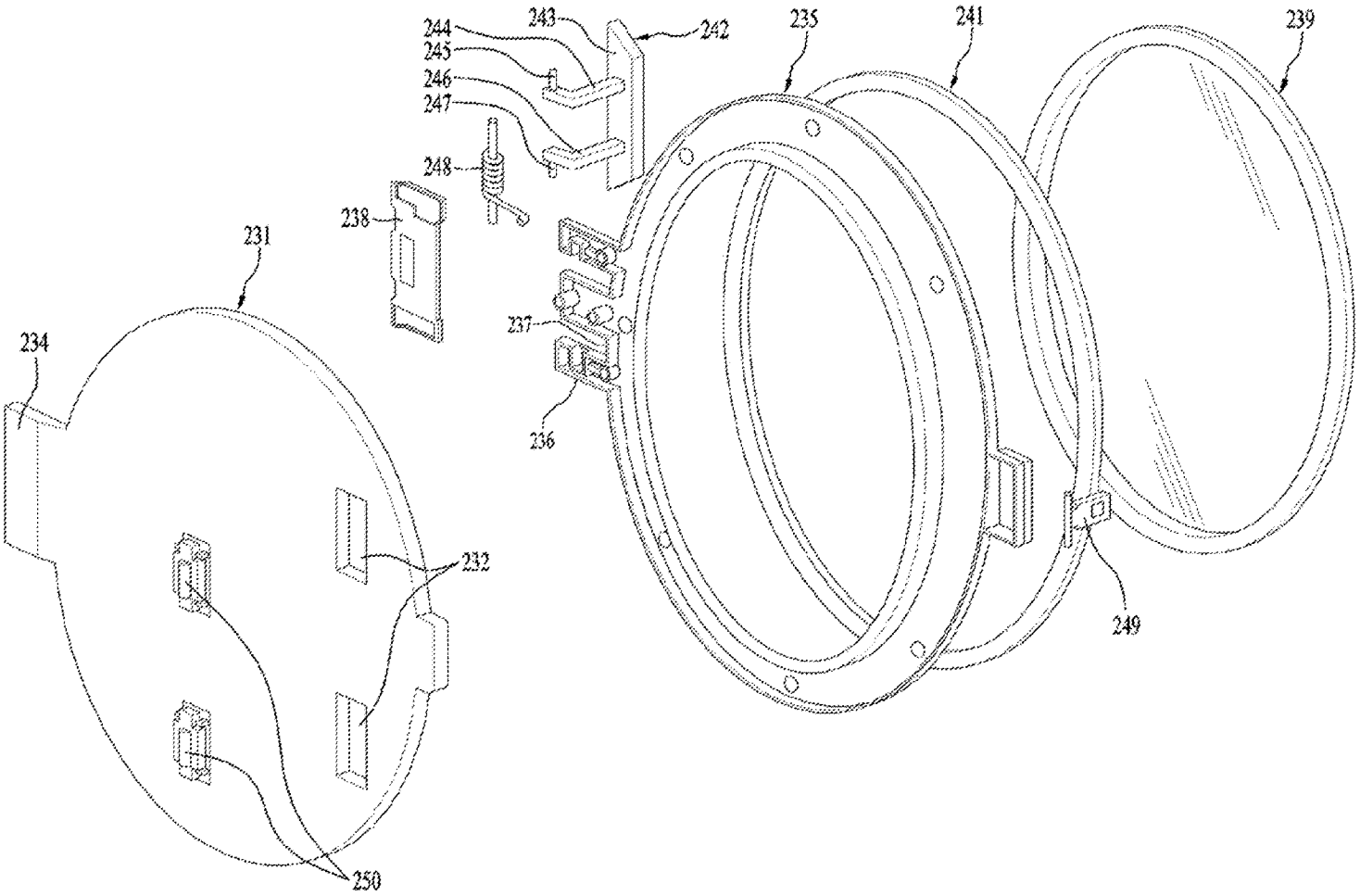
FIG. 12 is an exploded perspective view of an example tub door of a washing machine.
Figure 13:
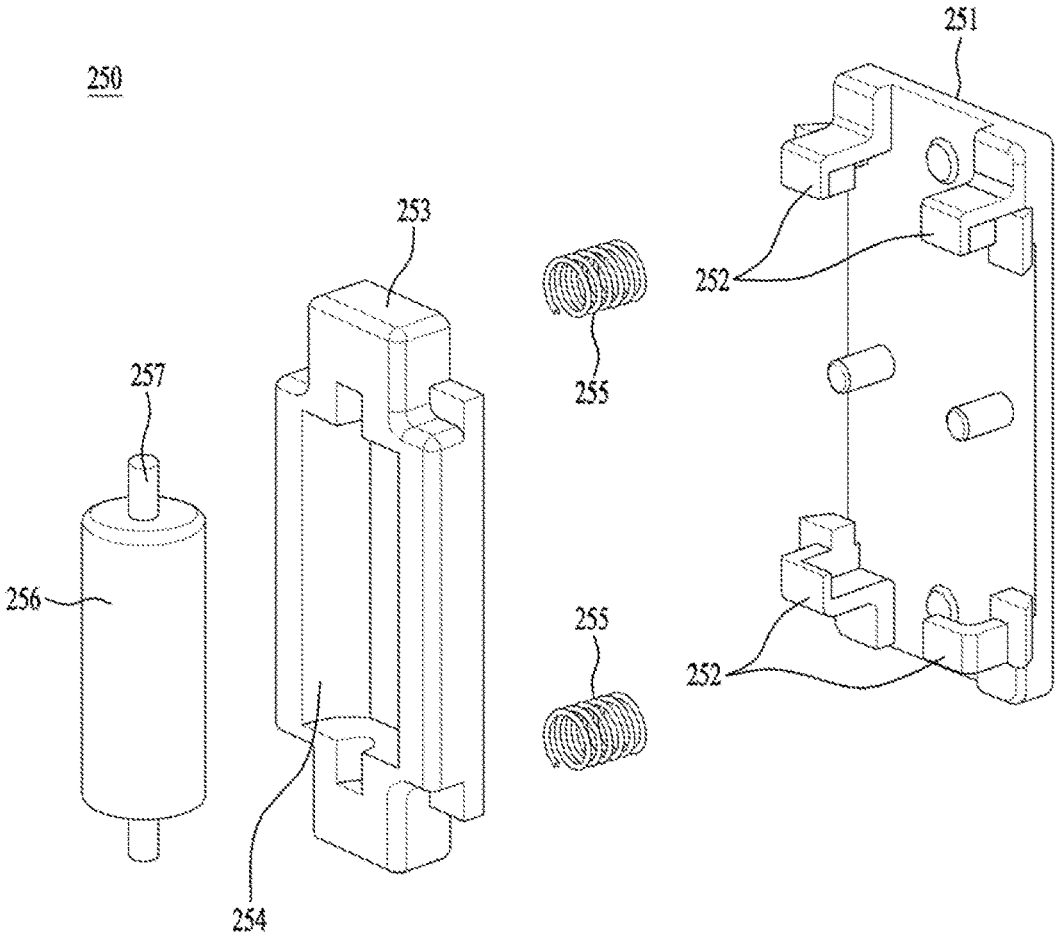
FIG. 13 is an exploded perspective view of an example push roller of a washing machine.

FIGS. 9 to 11 illustrate an example tub assembly of the washing machine. FIG. 12 illustrates an example tub door of a washing machine. FIG. 13 illustrates an example push roller of a washing machine.

As illustrated in the drawings, the tub 200 is provided at the front face thereof with the second introduction port 210, which is positioned on the extended line of the first introduction port 114 in the state of being separated from the first introduction port 114 of the cabinet 100 so as to allow laundry to be introduced into the tub 200 therethrough. The second introduction port 210 is provided with a ring-shaped rim 212, which extends toward the first introduction port 114 of the front cabinet 110. The rim 212 is provided therearound with a pair of weight balancers 270 and 280, which are intended to increase the weight of the tub 200 so as to prevent vibration of the tub 200. The rim 212 is further provided therearound with a pair of cover members 310 and 320 for covering the pair of weight balancers 270 and 280 and other structures of the front part of the tub 200. The second introduction port 210 is provided at a first side thereof with the tub door 230, which is separated from the cabinet 100 so as to open and close the second introduction port 210 of the tub 200.

The rim 212 is provided at a first side thereof with a second hinge mount 214, which is projected so as to allow the second hinge unit 242 to be mounted thereon, and is provided at a second side thereof with a tub door lock mount 216, on which is mounted the tub door lock 260 for setting the locked state of the tub door 230, which is adapted to open and close the second introduction port 210.

The rim 212 is disposed in the space between the tub 200, which is obliquely installed, and the front cabinet 110, so as to connect them to each other. Since the tub 200 is inclined at a predetermined angle (TT, see FIG. 14), the space between the second introduction port 210 of the tub 200 and the front cabinet 110 is configured to have an inverted triangular cross-section, which is larger at the upper portion than the lower portion thereof. In some implementations, the rim 212, which extends from the second introduction port 210, may extend further at the upper end than at the lower end thereof (see FIG. 14).

The angle of inclination of the end of the rim 212 is such that the upper end of the rim 212 is inclined toward the tub 200 at 1.5-3.5 degrees, and typically about 2.5 degrees, with respect to the vertical plane, which extends through the lower end of the rim 212. The configuration of the rim 212 is intended to increase the washing space, which is defined between the front face of the tub 200 and the tub door 230 for opening and closing the rim 212, thereby increasing the washing capacity of the tub 200. When the rim 212 of the tub 200 is inclined at a predetermined angle, as described above, the tub door 230, which is coupled to the rim 212, is also inclined at an angle corresponding to the angle of inclination of the rim 212 (TD, see FIG. 14). The tub door 230 is coupled to the rim 212 at an angle of inclination of 1.5-3.5 degrees, and typically at about 2.5 degrees, which is the same as the angle of inclination of the end of the rim 212.

The rim 212 of the tub 200 is provided therearound with the plurality of weight balancers 270 and 280, which are intended to increase the weight of the tub 200 so as to increase the resistance to vibrations transmitted to the tub 200.

The weight balancers 270 and 280 may be configured to have forms corresponding to the front part of the tub 200. In some implementations, since the weight balancers 270 and 280 are mounted in the ring-shaped space between the outer circumferential surface of the tub 200 and the outer circumferential surface of the rim 212, they may be configured to define a ring or arcuate shape corresponding to the ring shape.

Furthermore, the tub 200 may be provided in front thereof with the water supply unit for supplying washing water to the tub 200, an air supply unit for supplying dry air and the like. When the water supply unit, the air supply unit and the like are provided in front of the tub 200, the weight balancers 270 and 280 may be configured to avoid interference with the provided structures.

The weight balancers 270 and 280 take divided forms, that is, an upper weight balancer 270 and a lower weight balancer 280 for ease of coupling. The tub 200 may be provided on the front surface thereof with coupling bosses for coupling the respective weight balancers 270 and 280 and that the weight balancers 270 and 280 be respectively provided with a plurality of coupling portions 272 and a plurality of coupling holes 282, which are coupled to the coupling bosses.

Since the water supply unit, the air supply unit and the like are exposed from the space between the first introduction port 114 of the front cabinet 110 and the second introduction port 210 of the tub 200, the weight balancers 270 and 280 are directly exposed to the outside upon use of the washing machine, which is undesirable. Hence, there is a need to prevent the respective weight balancers 270 and 280, the water supply unit, the air supply unit and the like from being exposed through the space between the first introduction port 114 of the front cabinet 110 and the second introduction port 210 of the tub 200.

In some implementations, the weight balancers 270 and 280 may be provided thereover with the plurality of cover members 310 and 320 for preventing the weight balancers 270 and 280, the water supply unit, the air supply unit and the like from being directly exposed to the outside. The cover members 310 and 320 may include an upper cover member 310 and a lower cover member 320 for respectively covering the upper weight balancer 270 and the lower weight balancer 280. Each of the upper cover member 310 and the lower cover member 320 may be divided into one or more segments for assembly efficiency and shielding of other components.

Figure 20:
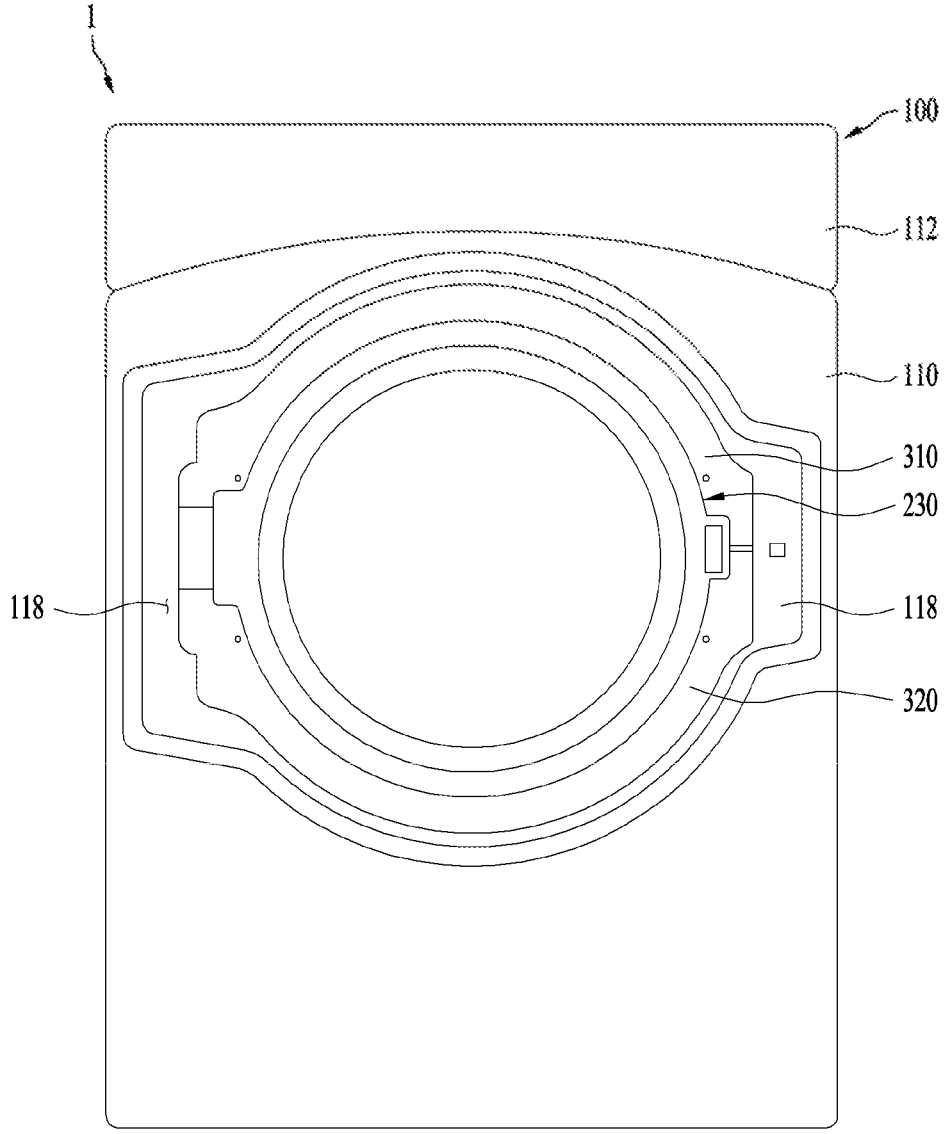

As illustrated in FIG. 11, the front circumferential region of the tub 200 (e.g. the space between the front circumferential surface of the tub 200 and the rim 212 of the second introduction port 210) is covered by the upper cover member 310 and the lower cover member 320. When the cabinet door 160 of the front cabinet 110 is opened, the space between the first introduction port 114 of the front cabinet 110 and the rim 212 of the second introduction port 210 is covered by the upper cover member 310 and the lower cover member 320 so as not to be exposed from the first introduction port 114 of the front cabinet 110 (see FIG. 20).

The tub 200 is provided at a first side of the front part thereof with the second hinge unit 242 so as to enable the tub door 230 to open and close the second introduction port 210. The tub 200 is provided at a second side of the front part thereof with the tub door lock 260 (see FIG. 15) for setting the locked state of the tub door 230. The tub door lock 260 is provided thereabove with the tub door lock releaser 220 (see FIG. 15) for releasing the locked state of the tub door lock 260.

The tub door 230, the tub door lock 260 and the tub door lock releaser 220 are not structurally connected to the cabinet 100, and the tub 200 is supported by a suspension that is structurally independent of the cabinet 100. In some implementations, since only the suspension may be provided between the tub 200 and the cabinet 100 without using a gasket such as that of the conventional washing machine 1 illustrated in FIG. 1, vibrations of the tub 200 may only be transmitted to the suspension, thereby remarkably reducing the transmission of vibrations of the tub 200 to the cabinet 100.

As illustrated in FIG. 12, the tub door 230 includes a second outer frame 231 defining the outer surface of the tub door 230, a second ring-shaped inner frame 235, which defines the outer circumferential surface of the tub door 230 and has a bore, a ring-shaped ring seal 241, which is disposed between the second outer frame 231 and the second inner frame 235 so as to create a seal between the second introduction port 210 of the tub 200 and the tub door 230, and a transparent frame 239 fitted into the bore of the second inner frame 235 so as to enable the inside of the tub 200 or the drum 400 to be checked from the outside.

The second inner frame 235 is provided at the first side thereof with a projection 236, on which the second hinge unit 242 is mounted. The projection 236 has recesses 237 in which upper and lower rotators 244 and 246 of the second hinge unit 242 and a torsional spring 248, which will be described later, are received. The second inner frame 235 is provided at the inner surface thereof with a holding bracket 238 for enabling the upper and lower rotators 244 and 246 and the torsional spring 248, which are received in the recesses 237, to be rotatably coupled thereto. The second inner frame 235 is provided at a second side thereof with a tub door hook 249, which is fitted into the tub door lock 260, which will be described later, so as to maintain the locked state of the tub door 230.

The second outer frame 231 is provided at the first side thereof with a projection 234 configured to cover the projection 236 formed on the second inner frame 235. The second outer frame 231 is further provided on the outer surface thereof with the push roller 250, which comes into contact with the roller-pushing surface 165*a* of the cabinet door 160 disposed outside the tub door 230, thereby pushing and opening the cabinet door 160 when the tub door 230 is rotated in the opening direction.

The push roller 250 is intended to prevent damage to the cabinet door 160 or the tub door 230, which occurs due to friction between the cabinet door 160 and the tub door 230 when the tub door 230 is opened by the torsional spring 248 of the second hinge unit 242. As illustrated in FIG. 13, the push roller 250 includes a stationary part 251 fitted into a roller fitting portion 232 formed in the second outer frame 231 of the tub door 230, a movable part 253 coupled to the stationary part 251 so as to be movable within a predetermined distance with respect to the stationary part 251, and a roller 256, which is disposed in the movable part 253 and has a rotating axis parallel to the rotating axes of the cabinet door 160 and the tub door 230.

The stationary part 251 includes a plurality of holding protrusions 252 formed at the corners thereof to restrict the moving distance of the movable part 253, thereby preventing separation of the movable part 253 by virtue of the holding protrusions 252. Springs 255 are provided between the stationary part 253 and the movable part 253 so as to bias the movable part 253 from the stationary part 251 by a predetermined elastic force. The movable part 253 is provided therein with a roller groove 254, in which the roller 256 is rotatably mounted.

When the tub door 230 is opened by the push roller 250, the push roller 250 comes into contact with the roller-pushing surface 165*a* formed on the first inner frame 165 and thus pushes the cabinet door 160, thereby opening the cabinet door 160.

The second hinge unit 242 is mounted on the second hinge mount 214, which is provided at the first side of the rim 212 of the second introduction port 210, so as to rotatably support the tub door 230 and provide the tub door 230 with a predetermined elastic force required to open the second introduction port 210.

The second hinge unit 242 includes a hinge body 243 mounted on the second hinge mount 214, the upper and lower rotators 244 and 246 extending from the upper and lower ends of the hinge body 243, upper and lower rotating shafts 245 and 247, which are provided at the ends of the upper and lower rotators 244 and 246, and which are rotatably received in the recesses 237 in the second inner frame 235, and the torsional spring 248, which has the same rotating axis as that of the upper and lower rotating shafts 245 and 247 and which provides the tub door 230 with elastic force required to open the tub door 230.

The distance between the upper and lower rotators 244 and 246 of the second hinge unit 242 may be less than the distance between the upper and lower rotators 171 and 173 of the first hinge unit 168. In other words, the first hinge unit 168 and the second hinge unit 242 support the cabinet door 160 and the tub door 230 such that the cabinet door 160 and the tub door 230 are rotatable about different rotating axes. In some implementations, in order to prevent the rotating shafts of the first and second hinge units 168 and 242 from interfering with each other, the rotating shafts of the first and second hinge units 168 and 242 are separated from each other with a space therebetween.

The tub door lock mount 216, which is provided at the second side of the second introduction port 210 of the tub 200, is provided with the tub door lock 260, into which the tub door hook 249 of the tub door 230 is fitted and locked, and is provided near the second introduction port 210 with the tub door lock releaser 220, which is actuated by the lock-releasing device 140 so as to release the locked state of the tub door lock 260.

The tub door lock releaser 220 is intended to release the locked state of the tub door lock 260 in response to a lock-releasing signal generated by the lock-releasing device 140. The tub door lock releaser 220 includes a solenoid 226 (see FIG. 15), which is actuated in response to a signal generated by the lock-releasing switch 186, a rotator 222, which is rotated by actuation of the solenoid 226, and a tension cable 224 for transmitting the rotational force of the rotator 222 to the tub door lock 260.

The tub door lock 260, which is intended to control the locked state of the tub door 230 provided at the second introduction port 210, includes the hook holder 181, secured to the tub door lock mount 216 near the second introduction port 210, and a cable connector 261 connected to the tension cable 224 of the tub door lock releaser 220 near the hook holder 181.

Although the tub door lock releaser 220 and the tub door lock 230 have been described as being configured to be separated from each other, the solenoid 226 of the tub door lock releaser 220 may be directly provided at the tub door lock 260 so as to release the locked state of the tub door lock 260 in response to the signal from the lock-releasing switch 186.

The operation of the washing machine will now be described in detail with reference to the accompanying drawings. The respective elements, which will be mentioned below, should be understood with reference to the above description and the accompanying drawings. An example feature of the washing machine resides in locking and/or releasing the cabinet door 160 and the tub door 230.

Prior to describing the operation of opening the cabinet door 160 and the tub door 230, the locked state of the cabinet door 160 and the tub door 230 is first described. The cabinet door 160 is maintained in the locked state by engagement of the cabinet door hook 175 of the cabinet door 160 with the cabinet door lock 180, and the tub door 230 is maintained in the locked state by engagement of the tub door hook 249 of the tub door 230 with the tub door lock 260.

Figure 15:
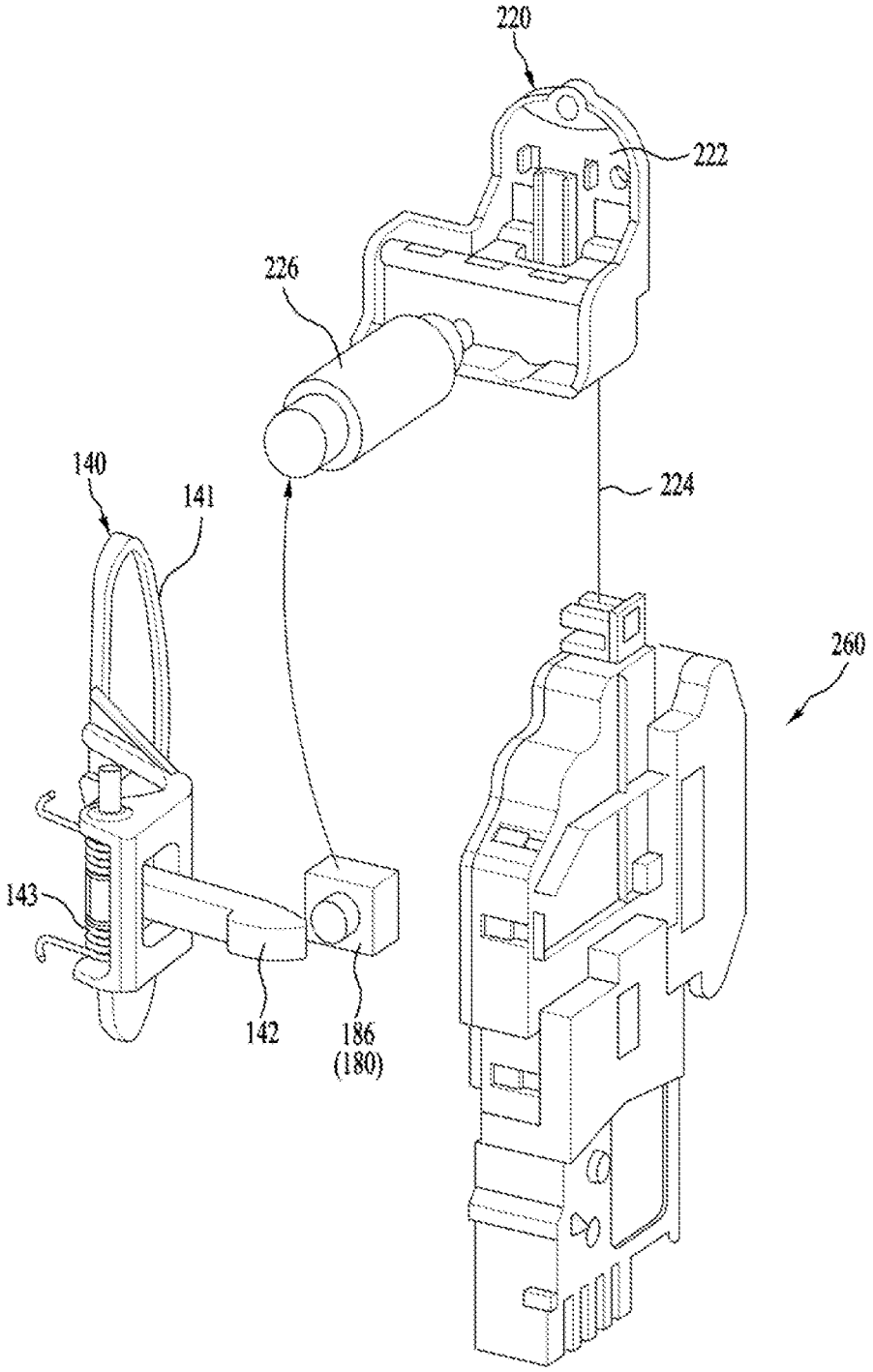
FIG. 15 is an exploded perspective view of an example lock-releasing device of a washing machine.
Figure 16:
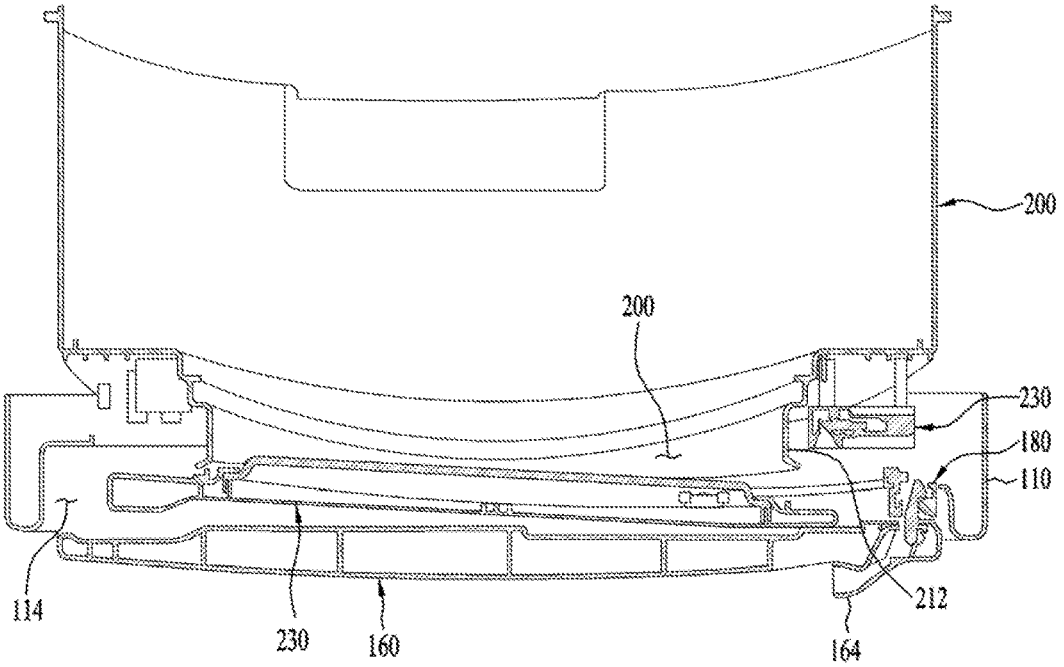
FIGS. 16 and 17 are plan cross-sectional views of example lock devices of a washing machine.
Figure 17:
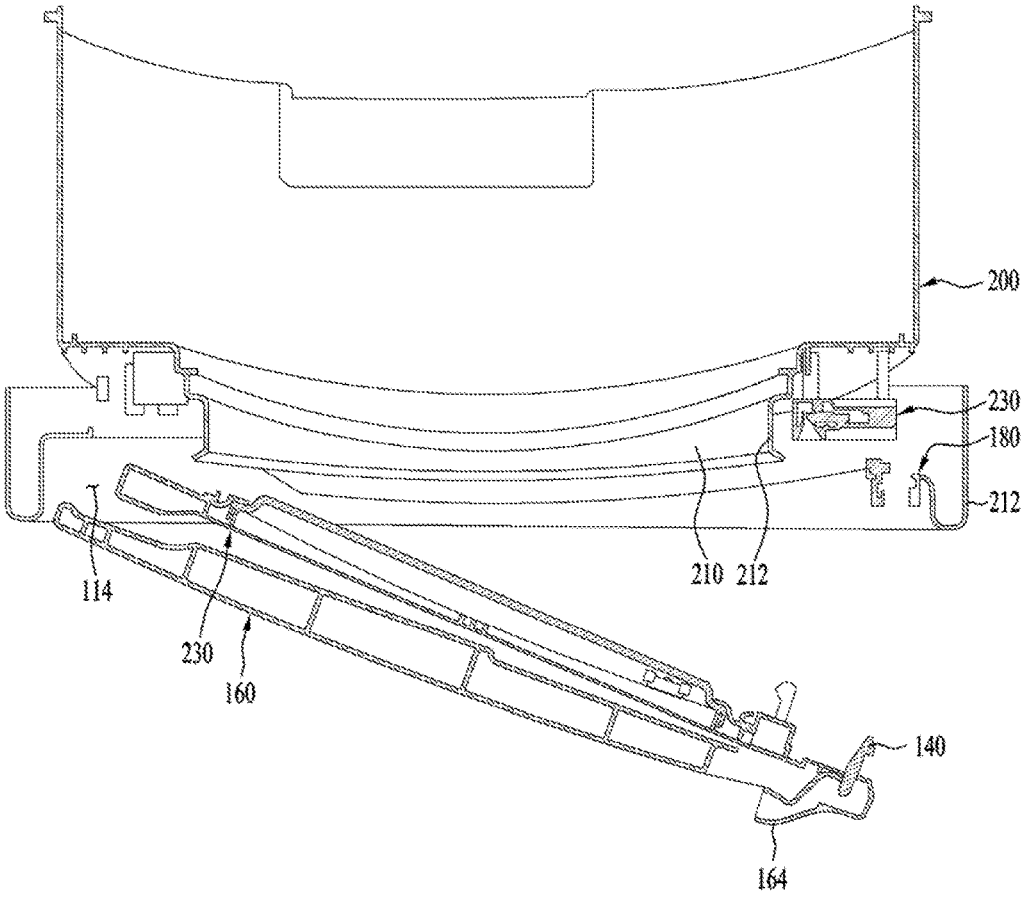

FIG. 15 illustrates an example lock-releasing device. FIGS. 16 and 17 illustrate example lock devices.

In order for a user to open the cabinet door 160 of the washing machine 1, a user grasps the handle 164 provided at the cabinet door 160 of the front cabinet 110 and applies force to the handle 164 in the direction in which the cabinet door 160 is opened. Consequently, the release lever 141 of the lock-releasing device 140 provided inside the handle 164 is rotated, and the locked state of the cabinet door hook 142 is released. At this time, the release switch 186 of the cabinet door lock 180 detects the release of the locked state of the cabinet door hook 142.

The solenoid 226 of the cabinet door lock releaser 150 is actuated in response to the detection of the release switch so as to rotate the rotator 222. As the rotator 222 is rotated, the cable connector 261 of the tub door lock 260 connected to the tension cable 224 of the rotator 222 is actuated, whereby the locked state of the tub door hook 249, secured to the hook holder 181 of the tub door lock 260, is released, and at the same time the locked state of the cabinet door 160 and the tub door 230 is released.

When the locked state of the cabinet door 160 and the tub door 230 is released, the tub door 230 is rotated in the opening direction by the torsional spring 248 provided at the second hinge unit 242 of the tub door 230. At this time, the push roller 250 provided at the second outer frame 231 of the tub door 230 pushes the roller-pushing surface 165*a*, and thus the cabinet door 160, in the opening direction, whereby the cabinet door 160 is opened by the tub door 230.

Figure 18A:
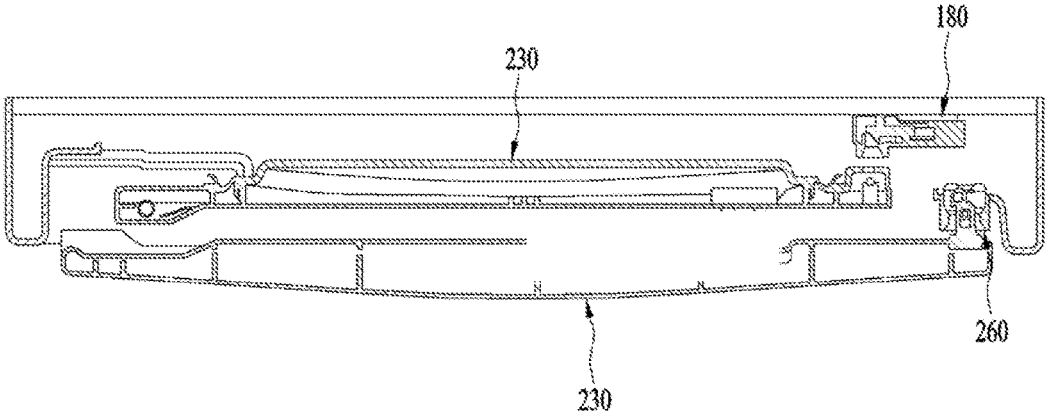
FIGS. 18(*a*) to 18(*c*) are plan cross-sectional views of example closing operations of a washing machine.
Figure 18B:
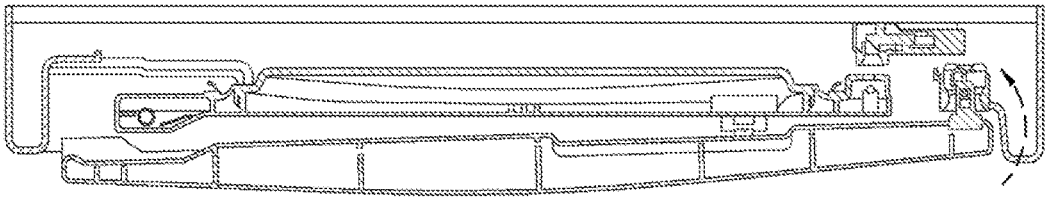
Figure 18C:
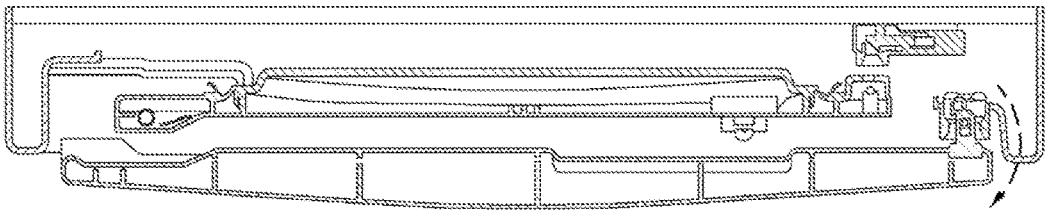
Figure 19:
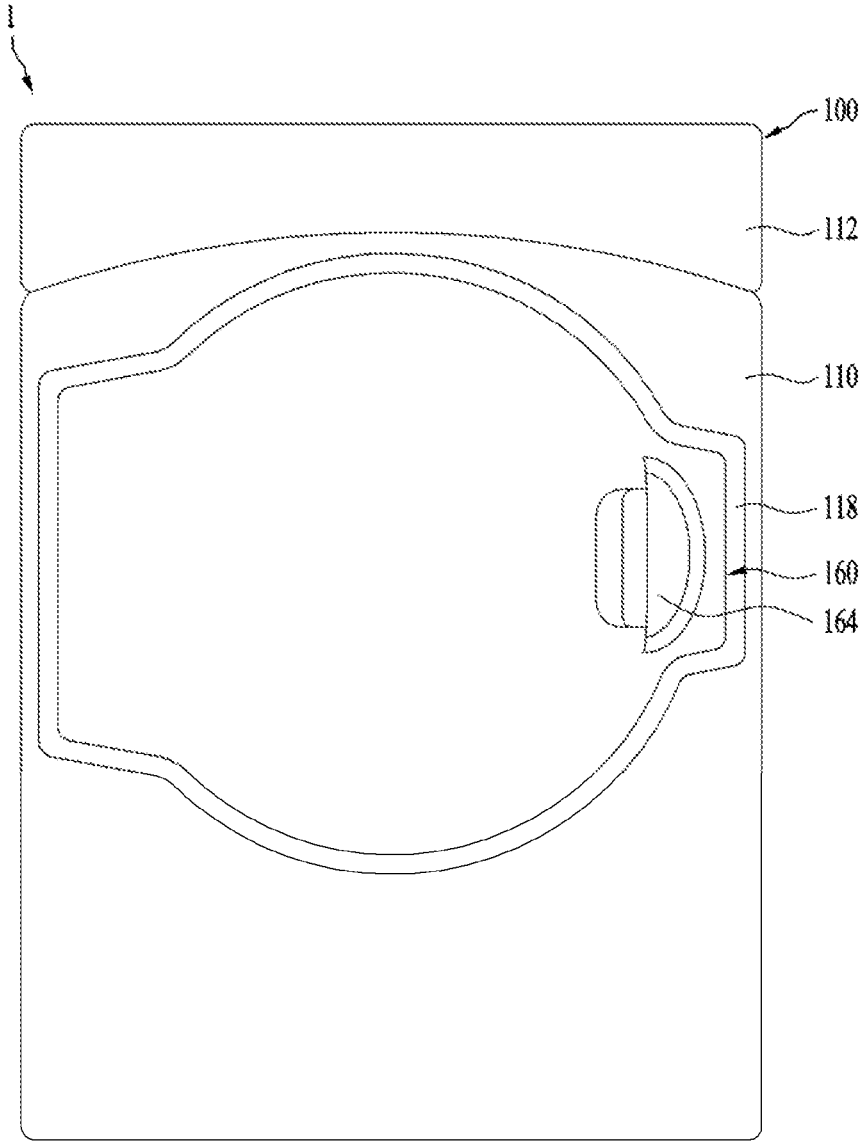
FIGS. 19 and 20 are front views of opening and closing of an example cabinet door of a washing machine.

FIGS. 18(*a*) to 18(*c*) illustrate example closing operations of a washing machine.

As illustrated in the drawings, in order to close the cabinet door 160 and the tub door 230, a user rotates the cabinet door 160 in the closing direction. At this time, the roller-pushing surface 165*a* formed on the first inner frame 165 of the cabinet door 160 comes into contact with the push roller 250 provided at the second outer frame 242 of the tub door 230, and the cabinet door 160 and the tub door 230 are thus rotated in the closing direction, against the elastic force of the rotational spring 248 provided at the second hinge unit 242 of the tub door 230.

As the cabinet door 160 and the tub door 230 are rotated, the cabinet door hook 175 of the cabinet door 160 is fitted into the cabinet door lock 180, and at the same time, the tub door hook 249 of the tub door 230 is fitted into the tub door lock 260 (see FIG. 18(*a*)).

When the cabinet door hook 175 of the cabinet door 160 is fitted into the cabinet door lock 180 by the action of closing the cabinet door 160, performed by a user, the cabinet door hook 175 is completely engaged with the cabinet door lock by the rotation of the cabinet door 160, while the hook fitting portion 183, into which the cabinet door hook 175 is fitted, is elastically supported by the spring. At this time, the tub door 230 is further moved by the distance corresponding to the distance that the hook fitting portion 183 of the cabinet door lock 180 is moved, and is engaged with the tub door lock 260 (see FIG. 18(*b*)).

Thereafter, the user's pushing force applied to the cabinet door 160 is released, and the hook fitting portion 183 of the cabinet door lock 180 is restored to the normal position by the elastic force of the spring, which supports the hook fitting portion 183. The cabinet door 160, which is engaged with the cabinet door lock 180, is restored to the position spaced apart from the tub door 230 by the restoring force of the hook fitting portion 183, thereby completing the operation of closing the cabinet door 160 and the tub door 230 (see FIG. 18(*c*)).

Since the cabinet door 160 and the tub door 230 of the washing machine are kept spaced apart from each other when they are closed, the direct transmission of vibrations of the tub to the cabinet is prevented during a washing operation.

As is apparent from the above description, the washing machine has an improved structure between the tub and the cabinet so as to prevent vibrations and noise of the tub from being transmitted to the cabinet, thereby reducing vibrations and noise generated from the cabinet. In some implementations, the washing machine offers an effect of preventing unpleasant vibrations and noise from being transmitted to a user.

Furthermore, the washing machine offers an effect of increasing the capacity of the tub by improving the structure between the tub and the cabinet.

What is claimed is:

1. A washing machine comprising:

a cabinet that defines a first introduction port;

a tub that is located in the cabinet and that defines a second introduction port that is concentrically positioned relative to the first introduction port;

a rim that is located around the second introduction port and that extends from the tub in a forward direction;

a weight balancer that is located on an outer circumferential surface of the rim and that is configured to increase a weight of the tub;

a water supply unit that is connected at the outer circumferential surface of the rim and that is configured to supply washing water to the tub;

a cabinet door that is connected to the cabinet and that is configured to open and close the first introduction port;

a tub door that is hingedly coupled to the tub, that is configured to open and close the second introduction port, and that includes an upper portion that is inclined toward the tub; and a cover member that is located between the first introduction port and a front surface of the tub, that is configured that is configured to cover the weight balancer and the water supply unit, and that is configured to prevent the front surface of the tub from being exposed through the first introduction port based on being coupled to the weight balancer.

2. The washing machine according to claim 1, wherein the tub is obliquely positioned and includes a front portion that is inclined upward, and the cabinet includes a front cabinet that includes an upper portion that is inclined rearward at a predetermined angle.

3. The washing machine according to claim 2, wherein the tub is inclined upward at an angle of 5-15 degrees relative to a bottom of the washing machine.

4. The washing machine according to claim 3, wherein the tub is inclined upward at an angle of 10 degrees relative to the bottom of the washing machine.

5. The washing machine according to claim 2, wherein the tub includes a rim that extends from the second introduction port to the first introduction port.

6. The washing machine according to claim 5, wherein an upper portion of the rim extends beyond a lower portion of the rim.

7. The washing machine according to claim 2, wherein the cabinet door is obliquely positioned and includes an upper portion that is inclined rearward at an angle of 1.5-3.5 degrees relative to a front of the washing machine.

8. The washing machine according to claim 7, wherein the cabinet door is inclined rearward at an angle of 2.5 degrees relative to the front of the washing machine.

9. The washing machine according to claim 2, wherein the tub door is obliquely positioned and includes an upper portion that is inclined rearward at an angle of 1.5-3.5 degrees relative to a front of the washing machine.

10. The washing machine according to claim 9, wherein the tub door is inclined rearward at an angle of 2.5 degrees relative to the front of the washing machine.

11. The washing machine according to claim 10, further comprising a lock-releasing device that is configured to unlock the tub door based on the cabinet door opening.

12. The washing machine according to claim 11, wherein the lock-releasing device comprises:

a release lever that is located at a handle of the cabinet door;

a release switch that is configured to detect an action of opening of the cabinet door in response to detecting an action of the release lever; and a tub door lock releaser that is configured to unlock the tub door lock in response to detecting an action of the release switch.

13. The washing machine according to claim 11, wherein the lock-releasing device comprises:

a release lever that is located at a handle of the cabinet door;

a release switch that is configured to detect an action of opening of the cabinet door in response to detecting an action of the release lever; and a tub door lock that is configured to unlock the tub door in response to detecting an action of opening by the release switch.

14. The washing machine according to claim 1, wherein the cabinet door includes a front hinge unit, and the tub door includes a second hinge unit that includes a rotating shaft that is spaced apart from the first hinge unit.

15. The washing machine according to claim 1, wherein the cover member includes one or more cover submembers that each cover a respective portion of the front surface of the tub.

16. The washing machine according to claim 1, wherein the cover member is connected to the rim and is configured to cover the front surface of the tub outside the rim.

17. The washing machine according to claim 1, further comprising:

an air supply unit that is located at the outer circumferential surface of the rim and that is configured to supply dry air to the tub, wherein the cover member is configured to cover the air supply unit.

18. The washing machine according to claim 1, wherein the tub door is elastically supported in a direction that the second introduction port opens.

19. The washing machine according to claim 1, wherein the cabinet door is configured to open based on opening the tub door.

20. The washing machine according to claim 1, wherein the tub door is configured to close based on closing the cabinet door.

21. The washing machine according to claim 1, wherein the cabinet includes a cabinet door lock that is configured to lock the cabinet door, and the tub includes a tub door lock that is configured to lock the tub door.

* * * * *